US006413415B1

(12) United States Patent
Weiss et al.

(10) Patent No.: US 6,413,415 B1
(45) Date of Patent: Jul. 2, 2002

(54) METHOD FOR HIGH-TEMPERATURE SHORT-TIME DISTILLATION OF RESIDUAL OILS

(75) Inventors: Hans Jürgen Weiss, Oberursel; Jörg Schmalfeld, Friedrichsdorf; Udo Zentner, Griesheim; Ingo Dreher, Oberursel; Willibald Serrano, Buxheim, all of (DE)

(73) Assignee: Metallgesellschaft Aktiengesellschaft, Frankfurt/Main (DE)

( * ) Notice: Subject to any disclaimer, the term of this patent is extended or adjusted under 35 U.S.C. 154(b) by 0 days.

(21) Appl. No.: 09/445,163

(22) PCT Filed: Jun. 3, 1998

(86) PCT No.: PCT/EP98/03319

§ 371 (c)(1),
(2), (4) Date: Jan. 3, 2000

(87) PCT Pub. No.: WO98/55564

PCT Pub. Date: Dec. 10, 1998

(30) Foreign Application Priority Data

Jun. 7, 1998 (DE) ..... 197 24 074

(51) Int. Cl.[7] ..... B01D 3/06; B01D 3/00

(52) U.S. Cl. ..... 208/361; 208/365

(58) Field of Search ..... 208/361, 365

(56) References Cited

U.S. PATENT DOCUMENTS 4,054,492 A * 10/1977 Rammler et al. ..... 201/12

OTHER PUBLICATIONS

Weiss Schmalfeld "Coking of Residue oils by the LR–Process" vol. 42, No. 6, Jun. 1, 1989, pp. 235–237.*

* cited by examiner

*Primary Examiner*—Walter D. Griffin
*Assistant Examiner*—Tam M. Nguyen
(74) *Attorney, Agent, or Firm*—Herbert Dubno

(57) ABSTRACT

High temperature flash distillation, for treating residual oils originating from crude oil refining, natural bitumen and/or tar sands, comprises feeding the oil to a mixer with granular hot coke, which serves as a thermal transfer medium. In mixing, 60–90% of the oil is vaporized. The non-vaporized fraction includes metal-containing asphaltenes. This fraction is further converted in the mixer, to oil vapor, gas and coke. Gases and vapor are withdrawn from the mixer, separately from the coke. The vapor phase is cooled and condensed to produce product oil. The gas itself is a further product. The coke is reheated and recycled to the mixer as the thermal transfer medium.

12 Claims, 2 Drawing Sheets

METHOD FOR HIGH-TEMPERATURE SHORT-TIME DISTILLATION OF RESIDUAL OILS

DESCRIPTION

Figure 1:
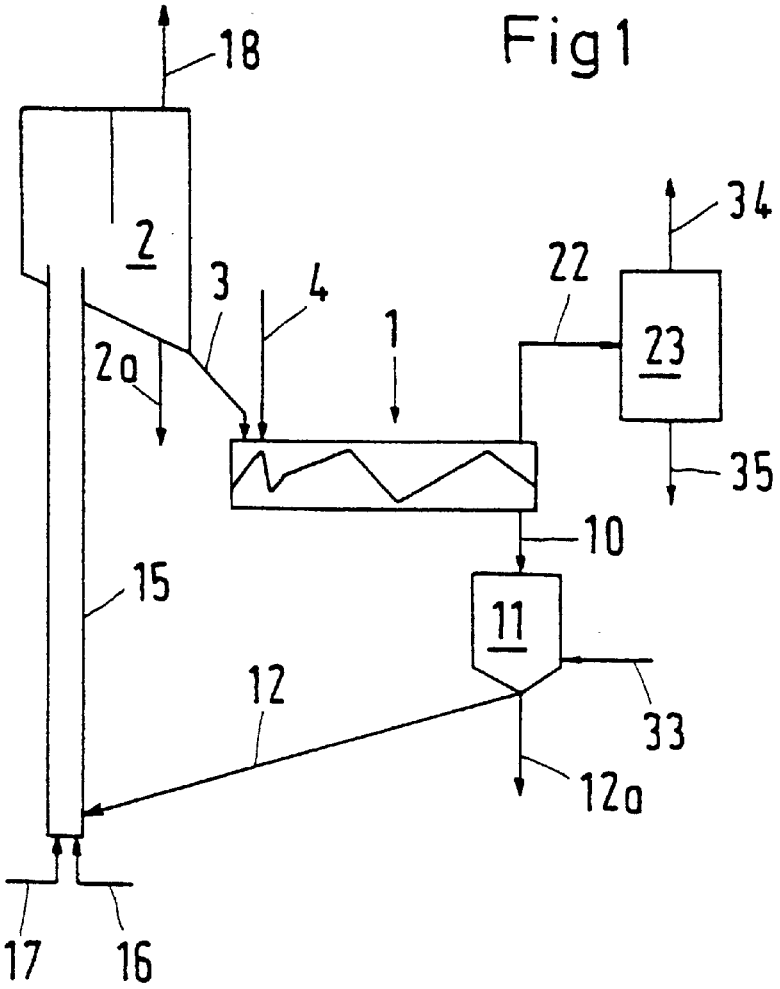

The invention relates to a process for high-temperature flash distillation of liquid residue oil originating from processing crude oil, natural bitumen or oil sand, wherein granular, hot coke as a heat carrier (heat carrier coke) is mixed with the residue oil in a mixer whereby 60 to 90 wt. % of the residue oil is vaporized, in the mixer the non-volatile portion of the residue oil containing the metal-laden asphaltenes is converted in the mixture containing the heat carrier to oil vapour, gas and coke, from the mixer the gases and vapours and the coke are separately withdrawn, gases and vapours are cooled and a product oil as a condensate and a gas are produced, the granular coke withdrawn from the mixer is reheated and recirculated to the mixer as heat carrier.

A similar process is known from the magazine "Erdöl und Kohle-Erdgas-Petrochemie/Hydrocarbon Technology" No. 42 (1989), pages 235 to 237, where a special mixer with intermeshing, uni-directionally rotating screws is presented which permits the gases and vapours to be discharged and cooled after only a very short retention time in the high-temperature zone of the mixer, thus suppressing undesirable cracking processes in the gas phase.

The objective of the present invention is to further develop the known process and optimize the conditions for continuous process operation. This results in maximizing the product oil yield and to minimize the content of heavy metals (nickel, vanadium), Conradson carbon (CCR) and heteroatoms (S, N) in the product oil.

Using the above process, this objective is accomplished in that the liquid residue oil is mixed in the mixer with hot heat carrier coke having a temperature of 500 to 700° C. at a weight ratio of 1:3 to 1:30, at least 80 wt. % of the heat carrier coke has a grain size range of 0.1 to 4 mm, at the beginning of the mixing a liquid residue film is formed on the heat carrier coke particles, the greater part of said film (e.g. 60 to 90%) being vaporized in the mixer at as low an operating temperature as possible in the range of 450 to 600° C. and preferably 500 to 560° C., the remaining liquid residue film on the coke is subsequently converted to oil vapour, gas and coke at a retention time of 6 to 60 seconds in the mixer, the coke withdrawn from the mixer is dry, largely free from liquid components and exhibits good flow properties and the gases and vapours liberated are withdrawn from the mixer after a retention time of 0.5 to 5 seconds.

Compared to the conventional vacuum distillation process, the process of the invention raises the equivalent final boiling point from about 560° C. to about 700° C. with a marked increase in the distillation yield. At the same time, the non-distillable, contaminant-laden (heavy metals, heteroatoms, CCR) asphaltenes are converted to oil, gas and coke and the contaminants preferably remain in the coke.

The lowest possible operation temperature in the mixer, when the coke withdrawn from the mixer is just dry and has good flow properties, results in the best yield and quality of the product oil.

Mixers suitable for the process include, for example, screw mixers, rotary drum mixers, paddle mixers, plough or vibration mixers. Moreover, mixers with intermeshing, uni-directionally rotating screws, which are known and are described in German Patent 12 52 623 and the corresponding U.S. Pat. No. 3,308,219 as well as in German Patent 22 13 861, can preferably be used. Due to the interaction of the screws, the formation of deposits on the screw surfaces and in the mixer housing is prevented.

Another embodiment of this process consists in passing the liquid residue oil through a first mixing section for mixing with the hot heat carrier coke and then through at least one further mixing section and hot heat carrier coke and the residue oil being fed to the mixer at the beginning of the first mixing section and gases and vapours are liberated at temperatures in the range of 450 to 600° C. in the first mixing section and further hot heat carrier coke being added to the mixture of heat carrier coke and remaining residue oil from said first section at the beginning of the second mixing section, the liberated gases and vapours being discharged from the first and/or second mixing section. This variant allows the adjustment of different temperatures within a range of 450 to 600° C. in the individual mixing sections.

If at least two mixing sections are used for mixing the residue oil with the hot heat carrier coke, the crucial first mixing section can be operated at low temperatures which promotes the capture of contaminants such as heavy metals (Ni, V), heteroatoms (S, N) and Conradson carbon (CCR) in the coke which is formed and, at the same time, suppresses undesirable cracking processes in the gas phase. These cracking processes result in increased $C_{4-}$ gas formation and hence, reduce $C_{5+}$ product oil yield and quality.

The second mixing section starts at the point where fresh heat carrier coke is added from the outside to the coke mixture coming from the first mixing section. Coke addition causes a temperature increase in the second mixing section and consequently temperature of the gases and vapours increases. Normally, the heat carrier coke is added in such a rate as to achieve a temperature increase of 5 to 50° C. This prevents dew-point underruns in the piping between the mixer and the condensing unit. At the same time, the higher temperatures accelerate the coking of the remaining, non-volatile, liquid residue components on the coke and hence, drying of the coke in the mixer so that the latter loses its stickiness. This is a prerequisite for ensuring good flowability of the coke in the heat carrier circuit. Furthermore, it is also possible to provide more than two mixing sections and add fresh coke at the beginning of each section.

When using a mixing system with several mixing sections, about 50 to 95% of the total hot heat carrier coke feed for the mixer is normally added to the first mixing section. The minimum hot coke feed rate at the beginning of the second and each further mixing section is 5%. of the total hot heat carrier coke feed. When using a mixer with only two mixing sections, the hot heat carrier coke is generally added at a weight ratio of 20:1 to 1:1 to the first and second mixing section.

Furthermore, it is possible to process in the second or a subsequent mixing section a liquid residue oil differing from that fed to the first mixing section. This allows, for example, the residue oil fed to the second mixing section to be treated at a higher temperature than the residue oil processed in the first section. Such a second residue oil may also be thermally treated in a second mixer connected partly in parallel with the first mixer and operating at higher temperatures, for example.

Moreover, it may be beneficial to preheat the liquid residue oil to temperatures of 100 to 450° C. before it is fed to the mixer. Preheating reduces both the viscosity of the residue oil and the heat requirement for valorization, so that the non-volatile proportion of the residue oil reaches the desired conversion temperature faster.

Furthermore, an oxygen-free gas or steam may be added to the mixer which offers the advantage of a reduced retention time of the liberated gases and vapours in the mixer.

The process of the invention permits about 80 to 95% of the heavy metals (Ni and V), about 50 to 70% of the Conradson carbon (CCR) and 30 to 70% of the heteroatoms (S and N) contained in the residue oil to be captured in the coke which is formed and a $C_5$. product oil with a yield of 70 to 85 wt. % is recovered from the residue oil. After separation of the naphtha and, where applicable, the kerosene and gasoil fractions, this product oil is suitable for catalytic processing.

Embodiments of the process are described Faith reference to the drawing. Each process variant presented uses mixers with intermeshing, uni-directionally rotating screws.

Figure 2:
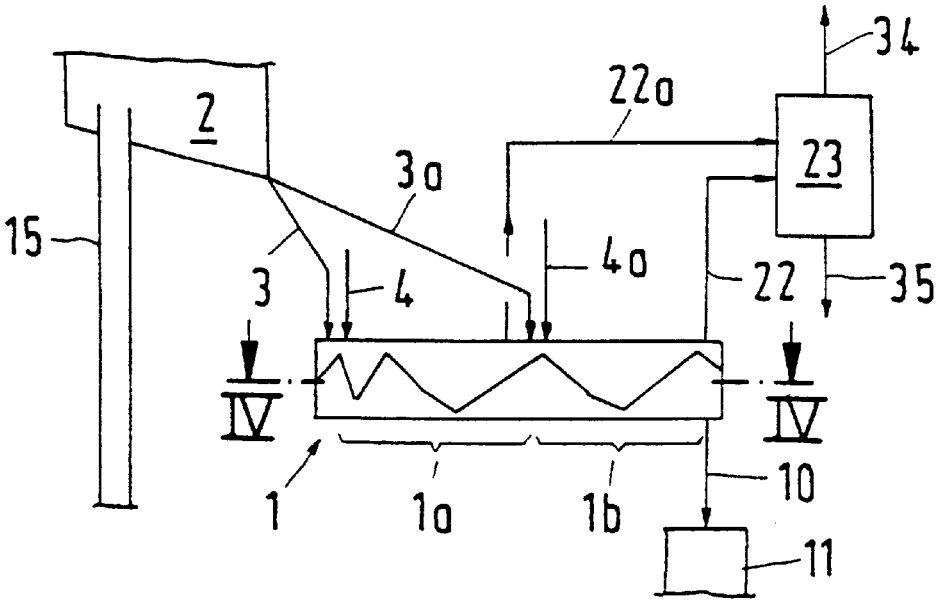
Figure 3:
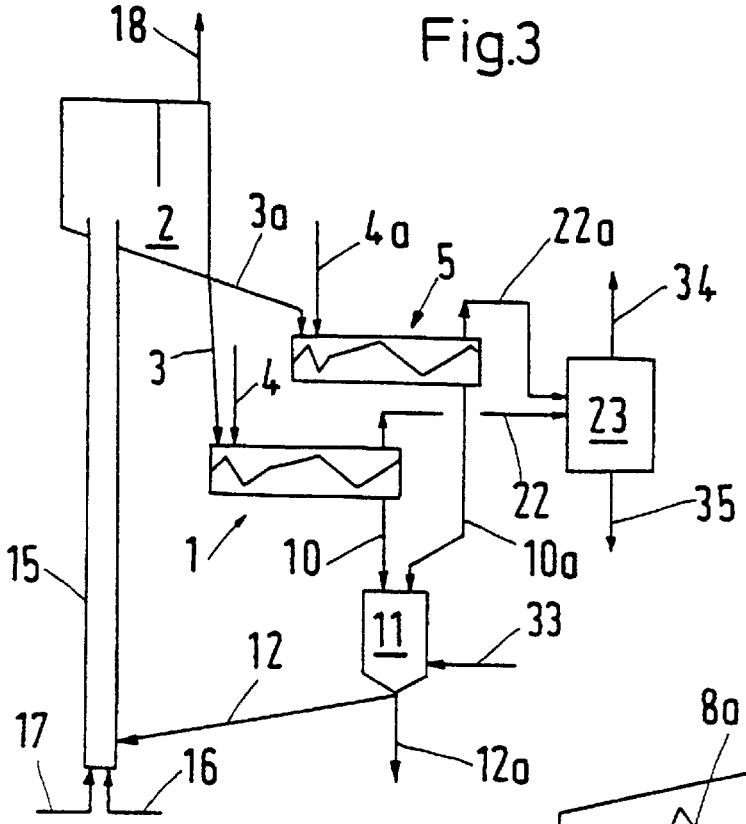
Figure 5:
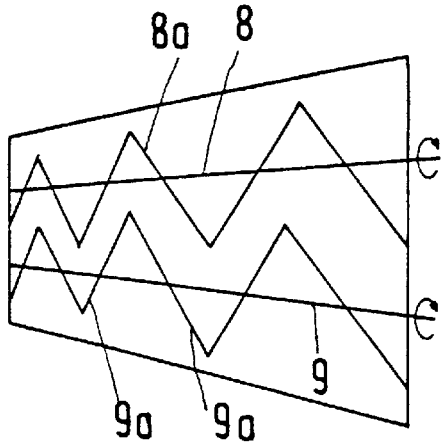
Figure 4:
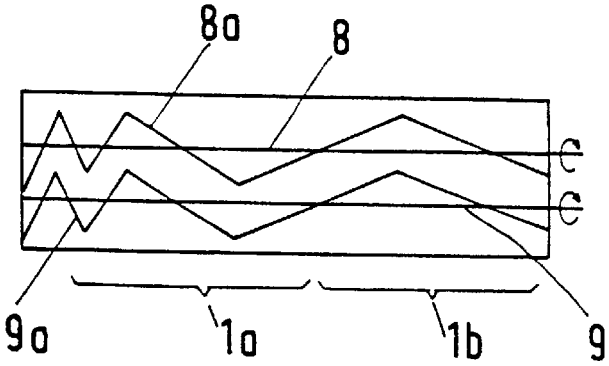
Figure 6:
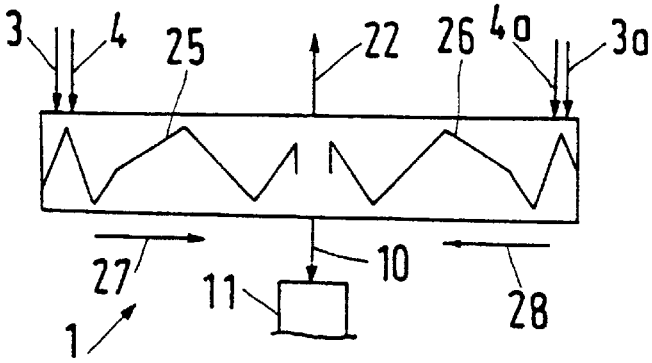

FIG. 1. shows a flow diagram of the process,

FIG. 2 shows a flow diagram of the process using a mixer equipped with two mixing sections, FIG. 3 shows a flow diagram of the process using two mixers, FIG. 4 is a diagrammatic representation showing a horizontal section through the mixer taken along line IV—IV in FIG. 2, FIG. 5 represents a horizontal section through a mixer with outward tapering screws, analogous to the representation in FIG. 4, and FIG. 6 shows a vertical section through a mixer with counter-rotating screws analogous to the representation in FIG. 1.

As shown in FIG. 1, the mixer (1) is fed via feed line (3) with hot heat carrier coke at 500 to 700° C. from collecting bin (2). Concurrently, residue oil with a temperature of preferably 100 to 450° C. is injected via line (4). The coke/residue oil weight ratio is in the range of 3:1 to 30:1, which results in a mixing temperature (conversion temperature) of 450 to 600° C. in the mixer. At least 80 wt. % of the heat carrier coke are present in the grain size range of 0.1 to 4 mm, the $d_{50}$ value being in the range of 0.2 to 2 mm to ensure maximum separation of the coke from the liberated gases and oil vapours at the mixer outlet.

In the present case, the mixer (1) is equipped with two intermeshing, uni-directionally rotating screws (8) and (9), as diagramatically shown in FIG. 4. Alternatively, the mixer may be equipped with three or more intermeshing, uni-directionally rotating screws, which may also be arranged in an outward tapering configuration (see FIG. 5). Each screw is designed as screw conveyor and equipped with helical flights (8*a*) or (9*a*) as shown in FIGS. 4*a* and 5. The helical flights (8*a*) and (9*a*) have different pitches along their lengths as shown in simplified form in FIGS. 4, 5 and 6. The flight pitch upstream of the residue oil feed point should preferably be shorter than the flight pitch in the reaction zone to ensure that the coke enters the reaction zone axially and is intimately mixed with the residue oil in the reaction zone as result of the increasing flight pitch.

As shown in FIG. 1, the hot, oil-free, granular coke discharges at the end of the mixer (1) at a temperature of 450 to 600° C. and drops through a duct (10) into a surge bin (11) provided with a stripping gas feed point at the bottom (33). Remaining gases and vapours can flow out of the surge bin (11) via duct (10) and discharge upwards. By means of line (12), coke is withdrawn from the bin (11), part of the coke being discharged from the system via line (12*a*) or line (2*a*). The remaining coke passes through line (12) to the bottom of a pneumatic lift pipe (15) which is supplied with combustion air via line (16) and, if required, fuel via line (17). The coke is entrained with the combustion gases to the top of the lift pipe (15) with part of the coke or the fuel added being burnt in the process. The coke heated up in the lift pipe (15) enters the collecting bin (2), waste gases being vented via line (18). The coke in collecting bin (2) has a temperature in the range of 500 to 700° C. and usually 550 to 650° C.

Gases and vapours exit the mixer (1) via duct (22) and enter into a condensation unit (23), where they are rapidly cooled. Product oil and gas are separately discharged via lines (35) and (34).

FIG. 2. shows a mixer with two mixing sections (1*a*) and (1*b*). At the beginning of the first mixing section (1*a*), hot coke from collecting bin (2) is fed to the mixer via line (3). At the same time, residue oil is fed via line (4) into the first mixing section (1*a*). At the beginning of the second mixing section (1*b*), further hot coke is added via line (3*a*) and, if desired, a second residue oil via line (4*a*). The gases and vapours liberated in mixing sections (1*a*) and (1*b*) are discharged from the mixer via the common discharge line (22) or (22*a*) and routed to the condensation unit (23).

FIG. 3 shows a process variant where two different residue oils are fed to two separate mixers (1) and (5) via lines (4) and (4*a*) where they are treated at different temperatures which are their respective optimum conversion temperatures. The mixer (1) shown in FIG. 6 is equipped with two pairs of counter-rotating screws (25) and (26) which result in opposite transport directions (27) and (28). Heat carrier coke is charged through lines (3) and (3*a*) while residue oil is injected via lines (4) and (4*a*). The coke is drawn off in the mixer centre through duct (10), while gases and vapours are discharged via line (22). Otherwise, the process is the same as that described together with FIG.1.

EXAMPLE

Using a process configuration as shown in FIG.1, 10 tons per hour of a vacuum residue from crude oil distillation having a temperature of 250° C. are injected into mixer (1) and mixed with 150 t/h of heat carrier coke having a temperature of 600° C. The vacuum residue contains 20 wt. % CCR, 740 mg/kg vanadium and 120 mg/kg nickel. At the resulting operating temperature of 540° C. in the mixer, 8.2 t/h of oil vapour and gas and 1.8 t/h of fresh coke are formed. The mixer is equipped with two intermeshing, uni-directionally rotating screws. The oil vapour/gas mixture is discharged from the mixer and routed to a condensation unit where it is separated into 8.6 t/h product oil ($C_{5+}$) containing 8.6 wt. % CCR, 83 mg/kg V and 11 mg/kg Ni, and also 1 t/h of gas ($C_{4-}$). The heat carrier coke discharging from the mixer together with the fresh coke having formed on its surface is largely free from liquid components and hence, dry and flowable.

What is claimed is:

1. A process for high temperature distilling of a liquid residue oil originating from processing crude oil, natural bitumen or oil sand, said liquid residue oil containing Konradson carbon, heterocyclic sulfur and nitrogen-containing compounds, and asphaltenes laden with heavy metal impurities wherein the heavy metal is selected from the group consisting of nickel and vanadium, which comprises the steps of:

(a) mixing the liquid residue oil in a mixer with heat carrier coke particles having a temperature of 500 to 700° C. at a weight ratio of 1:3 to 1:30, wherein at least 80% of the heat carrier coke particles have a grain size in the range of 0.1 to 4 mm to form as a mixture a liquid residue oil film on the heat carrier coke particles;

(b) vaporizing 60 to 90% by weight of the liquid residue oil film at a temperature of from 450° C. to 600° to form an oil vapor/gas mixture in the mixer;

(c) converting the remaining part of the liquid residue oil film containing the asphaltenes laden with the heavy metal impurities into additional oil vapor/gas mixture and additional coke particles during a retention time of 6 to 60 seconds in the mixer;

(d) discharging the coke particles formed during step (c) from the mixer, said coke particles being dry, having good flow properties, and largely free from liquid components, reheating the coke particles discharged from the mixer and recirculating the reheated coke particles to the mixer according to step (a) as additional heat carrier coke particles;

(e) withdrawing from the mixer the oil vapor/gas mixture formed during steps (b) and (c) after a retention time of 0.5 to 5 seconds, where not more than 25% of the heavy metal impurities in the liquid residue oil are included in the oil vapor/gas mixture withdrawn; and (f) condensing the oil vapor/gas mixture withdrawn during step (e) to obtain separately a $C_{5+}$ product oil condensate and a $C_{4-}$ product gas.

2. The process defined in claim 1 wherein 50% to 70% of the Konradson carbon and 30 to 70% of the heterocyclic sulfur and nitrogen from the liquid residual oil are transferred into the additional coke particles formed in the mixer according to step (c).

3. The process defined in claim 1 wherein the mixer according to step (a) is a mixer with intermeshing, unidirectionally rotating screws.

4. The process defined in claim 1 wherein according to step (a) the liquid residue oil is mixed with the heat carrier coke and the mixture is passed through a first mixing section and then through at least one second mixing section, the heat carrier coke and the liquid residue oil being fed to the mixer at the beginning of the first mixing section, and an oil vapor/gas mixture being liberated in the first mixing section at temperatures in the range of 450 to 600° C., further heat carrier coke being added to the mixture of coke and remaining liquid residue oil from the first mixing section at the beginning of the second mixing section, and gases and vapors are withdrawn from the mixer in the first or second mixing sections.

5. The process defined in claim 4 wherein 50 to 95% of the total heat carrier coke fed into the mixer is introduced into the first mixing section.

6. The process according to claim 4 wherein to the second mixing section or to a following mixing-section a liquid residue oil is fed, which differs from the liquid residue oil fed to the first mixing section.

7. The process defined in claim 1 wherein according to step (a) one or several liquid residue oils is subjected to high temperature flask distillation in several mixers.

8. The process defined in claim 1 wherein according to step (a) the liquid residue oil is fed into the mixer at a temperature in the range of 100 to 450° C.

9. The process defined in claim 1 wherein according to step (a) an oxygen-free, gaseous or vaporous fluid is injected into the mixer.

10. The process defined in claim 3 wherein according to step (a) a mixer with conical screws is used.

11. The process defined in claim 3 wherein according to step (a) a mixer with at least three screws is used.

12. The process defined in claim 3 wherein according to step (a) a mixer equipped with screws with opposite transport directions is used, and the heat carrier coke and the liquid residue oil are fed at both ends of the mixer so that the mixture of heat carrier coke and liquid residue oil is transported from both ends to the center of the mixer where the heat carrier coke is withdrawn downward from the mixer.

* * * * *